US005662719A

United States Patent [19]

Dawson et al.

[11] Patent Number: 5,662,719

[45] Date of Patent: Sep. 2, 1997

[54] LIGHTER APPARATUS

[75] Inventors: Robert Dawson, New South Wales; Clive Featherby, Queensland, both of Australia

[73] Assignee: Four-D Enterprises, Inc., San Diego, Calif.

[21] Appl. No.: 644,174

[22] Filed: May 9, 1996

[30] Foreign Application Priority Data

May 9, 1995 [AU] Australia ..... PN2878

[51] Int. Cl.[6] ..... C10L 11/06

[52] U.S. Cl. ..... 44/506; 44/507; 44/519

[58] Field of Search ..... 44/506, 507, 508, 44/509, 530, 531, 532, 534, 519

[56] References Cited

U.S. PATENT DOCUMENTS

| | | | |
|---|---|---|---|
| 421,917 | 2/1890 | Farrel | 44/508 |
| 618,997 | 2/1899 | Rose | 44/508 |
| 1,275,543 | 8/1918 | Fear | 44/508 |
| 1,942,899 | 1/1934 | Parsons | 44/508 |
| 2,261,467 | 11/1941 | Hanson | 44/506 |
| 4,692,168 | 9/1987 | Dotson et al. | 44/530 |
| 5,279,628 | 1/1994 | Hutchens et al. | 44/506 |

*Primary Examiner*—Margaret Medley

*Attorney, Agent, or Firm*—Brown, Martin, Haller & McClain

[57] ABSTRACT

A lighter or igniter apparatus for igniting fireworks, pyrotechnic set pieces or ordnance has a carrier tape with a first face coated with adhesive and a strip of fuel such as gunpowder applied to the first face at a location spaced from the opposite side edges of the tape. A cover or closure device encloses the strip of fuel on the tape. In one example, a second tape is adhered to the first face of the carrier tape covering the strip of fuel. The second tape is narrower so as to leave adhesive side edge portions of the carrier tape exposed for adhering the device to supports of a pyrotechnic display for ignition purposes.

10 Claims, 1 Drawing Sheet

LIGHTER APPARATUS

BACKGROUND OF THE INVENTION

This invention relates to a lighter or igniter apparatus.

This invention has particular but not exclusive application to an igniter apparatus for pyrotechnic set pieces, and for illustrative purposes, reference will be made to such application. However, it is to be understood that this invention could be used in other applications such as general pyrotechnics, for lighting fuses or detonators for other fireworks or ordnance applications.

In pyrotechnics and the like, a charge of gunpowder or other flammable material placed in a paper several centimeters long is termed a match, sometimes referred to as a "quick match". A match may be used to fire set pieces, aerial shells, mine bags and the like, and/or a match may be used to link up for multiple firing all types of fireworks. The match may comprise a length of string coated with gunpowder or meal powder, dried and enveloped inside a paper tube or sleeve.

The process for the construction and application of a quick match is slow and time consuming and can only be carried out when the weather is low in humidity. Gunpowder is mixed with a binding agent, wetted with water and wiped onto the string. The coated string is left for a time sufficient for it to dry and then placed into a strip of paper which is pasted and joined along its longitudinal edges.

The gunpowder usually includes as oxidizing agents, potassium perchlorate ($KClO_4$) and/or potassium nitrate ($KNO_3$), both of which attract moisture which makes the gunpowder difficult or impossible to ignite. Also, moisture may dampen the outer paper sleeve which can result in a breakdown in the quick match, possibly in the middle of a firing where such breakdown can be a safety hazard for a pyrotechnic operator.

Also, application of a quick match on a set piece is slow and time consuming. For example, the match is often required to be unbundled, strung out and held on the end of a lance with one hand and then with the other hand the operator is required to place a piece of adhesive tape on one side of the lance, over the match and then onto the other side of the lance. Each lance has to be pricked for use with a match of this nature, a high labor cost and also a safety hazard.

SUMMARY OF THE INVENTION

The present invention aims to alleviate at least one of the above disadvantages and to provide a lighting apparatus which will be reliable and efficient in use.

With the foregoing in view, this invention resides broadly in a lighter apparatus including a carrier tape, a fuel means disposed in a continuous strip along an intermediate portion of the carrier tape, and a closure means for enclosing the fuel means on the carrier tape.

The closure means may be constituted by a settable liquid, paste or such like applied to the carrier tape, such as a gum, resin, adhesive or such like. Alternatively, the closure means may include a plastic or resin adhesive in strip or tape form and a second closure tape applied to the carrier tape about and enclosing the fuel means, or the second closure tape may be sealingly fixed to the carrier means by solvent or fusion welding or such like.

Preferably, the carrier tape is preferably constructed from a plastics material and includes an adhesive layer disposed on at least one surface and the closure means is constituted by a second closure tape means adhered to the carrier tape by the adhesive. Further, it is preferred that the second closure tape is an adhesive tape adhered to the carrier tape with an adhesive surface left exposed, and/or wherein at least some of the adhesive carrier tape is left exposed along its longitudinal edge portions.

For example, the second closure tape may be constituted by a second adhesive tape of similar construction to the carrier tape but narrower than the first adhesive tape and with substantially straight longitudinal edges so as to leave adhesive tape on either side of the full length of the first tape, although it will be appreciated that the second tape may be non-adhesive or may have both sides adhesive.

Alternatively, the closure means may be constituted by providing a longitudinal fold in the carrier tape so as to enclose the fuel means by joining an edge portion of the carrier tape to another portion of the carrier tape substantially parallel to the edge portion of the carrier tape being so joined. The carrier tape may be provided with adhesive for this purpose, or the carrier tape may be provided in a plastically deformable form and be plastically deformed to enclose the fuel means.

In a further alternative form, the carrier tape may be provided with a groove to receive the fuel means and further deformed to close the groove upon itself with the fuel means therein. A closure tape may be provided to prevent the closed groove from opening.

It is also preferred that the carrier tape means includes or have formed therein channel means for receiving the fuel means. Suitably, the channel means includes a groove or channel formed by a roller which engages with the carrier tape as it is uncoiled from a roll. It is believed that the channel means permits that if there is a break in the continuous strip, a cavity is formed through which hot gas formed as a product of combustion of the fuel means may travel for to reignite the fuel means.

Preferably, the carrier tape and closure means are water resistant, or at least substantially waterproof and flammable whereby the lighter is capable of igniting a lance without the need to prick same and/or may be utilized in wet and/or humid conditions. It will be appreciated that the lighter apparatus of this invention is not intended to be immersed in water or used in underwater applications. Suitably, the fuel means includes a fuel such as gunpowder, meal powder or such like.

BRIEF DESCRIPTION OF THE DRAWINGS

In order that this invention may be more readily understood and put into practical effect, reference will now be made to the accompanying drawings which illustrate a typical embodiment of the invention and wherein.

DESCRIPTION OF THE PREFERRED EMBODIMENT

Figure 1:
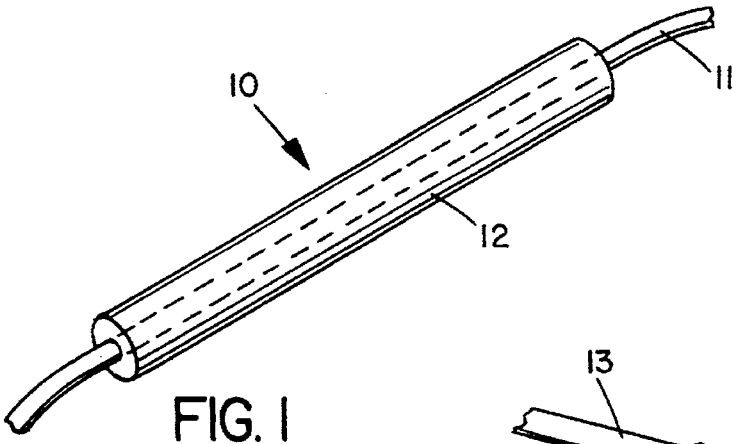
FIG. 1 PRIOR ART
FIG. 1 is a schematic representation of a quick match according to the prior art.
Figure 2:
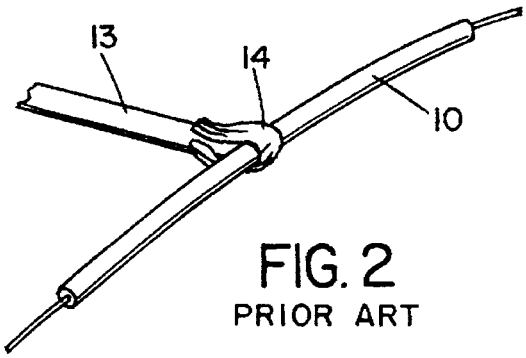
FIG. 2 PRIOR ART
FIG. 2 is a diagrammatic representation of the connection between a quick match of FIG. 1 and a lance.

Referring to FIG. 1, a match 10 is constructed from a length of string 11 coated with gunpowder or meal powder which is encapsulated in an outer sleeve 12. Referring to FIG. 2, the match 10 is attached to the distal end of a lance 13 by means of adhesive tape 14 applied to the end of the lance 13 and around the match 10 as shown.

Figure 3:
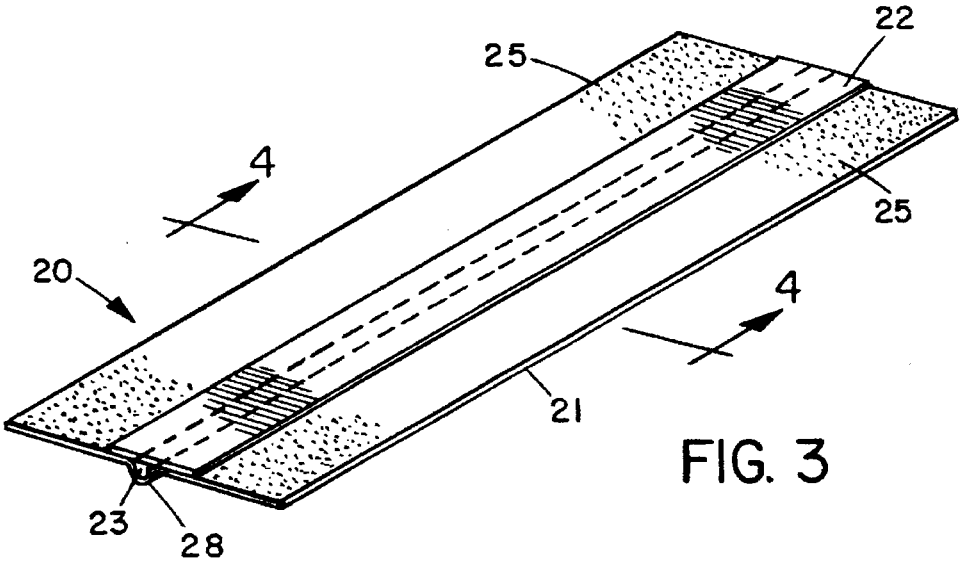
FIG. 3 is a diagrammatic representation of a lighter apparatus according to a preferred embodiment of the present invention.
Figure 4:
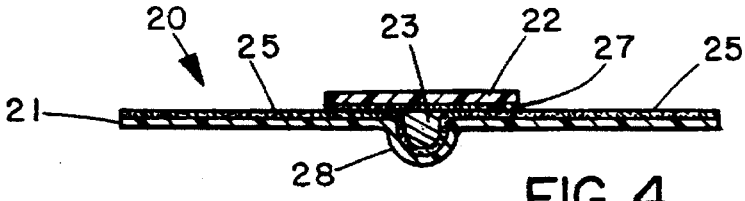
FIG. 4 is a section on the lines 4—4 of FIG. 3.

FIGS. 3 and 4 illustrate a dry match or lighter apparatus 20 according to a preferred embodiment of the present invention. The match basically comprises an elongate carrier tape 21 with first and second opposite faces and a fuel supply 23 disposed in a continuous strip along one face of the tape and spaced from the opposite side edges of the tape. A closure device 22 is provided for enclosing the fuel supply on the carrier tape. In the illustrated embodiment, the carrier tape has an adhesive surface which is face up in FIG. 3, while the closure device 22 comprises a second, narrower tape which has an adhesive surface 27 (face down on FIG. 3). The strip 23 of fuel supply such as gunpowder or meal powder is interposed substantially centrally of the closure tape 22 and carrier tape 21.

The carrier tape is wider than the closure tape 22 such that the match 20 has two adhesive side portions 25. The match 20 may be rolled into a coil in which the adhesive side portions 25 of the carrier tape 21 are adhered to the non-adhesive side of the carrier tape 21 in the layer below on the coil and in use, the match 20 may be adhered to supports and/or fireworks by one or both adhesive side portions 25. If desired, for ease of handling, once installed, the adhesive side portions 25 may be adhered to one another, or folded over onto the closure tape 22.

In use, a match apparatus of the present invention may be assembled by forming a groove 28 centrally into and along the adhesive side of an adhesive tape. Using a tape having a width of 50 mm, a groove 10 mm wide at the top, and tapering to a width of 5 mm at a depth of 5 mm, the groove is filled with 100 grams of powder for every 15 meters of tape and the groove is closed with an adhesive tape having a width of 20 mm being placed with its adhesive side against the adhesive side of the 50 mm tape leaving the side edges of the wider tape exposed.

As it is being assembled, the lighter apparatus may be stored on a roll by coiling the lighter apparatus upon itself. The application of the lighter apparatus to a job may be achieved by unrolling the coil and using the adhesive edges to stick the lighter apparatus to supports so that the lighter apparatus follows a desired course, including the operative attachment of the lighter apparatus to a lance for a firework or the like.

The tape may be clear or transparent, or it may include safety information or warnings or such like, or may include advertising material or such like.

It will of course be realized that the above has been given only by way of illustrative example of the invention and that all such modifications and variations thereto as would be apparent to persons skilled in the art are deemed to fall within the broad scope and ambit of the invention as is herein set forth.

We claim:

1. An igniter tape, comprising:

an elongate carrier tape having opposite first and second faces and opposite longitudinal side edges;

a fuel supply disposed in a continuous strip extending lengthwise along the first face of the carrier tape, the fuel supply strip being spaced inwardly from the side edges of the carrier tape; and a closure layer for enclosing the fuel supply on the carrier tape.

2. The tape as claimed in claim 1, wherein further a layer of adhesive is applied to the first face of the carrier tape, prior to application of said fuel supply strip the adhesive comprising the closure layer, and the carrier tape being folded to form a longitudinal fold with the fuel supply on the inside of the fold and opposing inner portions of the first face adhered to one another.

3. The tape as claimed in claim 1, wherein the closure layer comprises a second elongate tape which is narrower than said first-mentioned tape, the carrier tape having a layer of adhesive applied prior to application of said fuel supply strip on said first face and said second tape being placed along said first face of the carrier tape covering said fuel supply.

4. The tape as claimed in claim 3, wherein said second elongate tape is positioned to leave opposite side edge portions of said carrier tape exposed on each side of said second tape.

5. The tape as claimed in claim 3, wherein said second elongate tape has an adhesive coating on one face, and said one face is placed over said first face of said carrier tape and said fuel supply.

6. The tape as claimed in claim 1, wherein said carrier tape has a longitudinal groove extending along said first face at a location spaced from said opposite side edges, and said fuel supply is received in said groove.

7. The tape as claimed in claim 6, wherein said carrier tape has an adhesive coating on said first face, and said closure layer comprises a second elongate tape which is narrower than said carrier tape, the second tape being placed lengthwise along said first face of said carrier tape in a position covering said fuel supply in said groove, at least one side portion of said first face of said carrier tape being exposed for adhering said tape to an object to be ignited.

8. The tape as claimed in claim 7, wherein said second tape is positioned on said carrier tape at an intermediate location with opposite side edges of said second tape spaced inwardly from the respective opposite side edges of said carrier tape to leave opposite side portions of said carrier tape exposed.

9. The tape as claimed in claim 7, wherein said carrier and second tapes are each of substantially water proof material.

10. The tape as claimed in claim 1, wherein, at least one of the carrier and closure tapes having an adhesive layer applied to one of its faces, and said closure tape being placed along said first face of the carrier tape covering said fuel supply strip.

* * * * *